US005757942A

United States Patent [19]

Kamatani et al.

[11] Patent Number: 5,757,942

[45] Date of Patent: May 26, 1998

[54] SPEAKER UNIT WITH AN IMPROVED ACOUSTIC EQUALIZER

[75] Inventors: Yoshiteru Kamatani, Kanagawa; Nobuo Fuke, Chiba, both of Japan

[73] Assignee: Sony Corporation, Tokyo, Japan

[21] Appl. No.: 742,780

[22] Filed: Oct. 31, 1996

[30] Foreign Application Priority Data

| | | | |
|---|---|---|---|
| Nov. 13, 1995 | [JP] | Japan | 7-294426 |
| Nov. 13, 1995 | [JP] | Japan | 7-294427 |
| Feb. 19,.1996 | [JP] | Japan | 8-030552 |

[51] Int. Cl.[6] ..... H04R 25/00

[52] U.S. Cl. ..... 381/156; 381/192; 181/152

[58] Field of Search ..... 381/156, 192, 381/194, 199, 201; 181/152, 159, 177, 199, 175

[56] References Cited

U.S. PATENT DOCUMENTS

| | | | |
|---|---|---|---|
| 2,037,187 | 4/1936 | Wente | 381/156 |
| 2,907,837 | 10/1959 | Brami | 381/156 |
| 4,256,930 | 3/1981 | Garner et al. | 381/156 |

*Primary Examiner*—Huyen D. Le
*Attorney, Agent, or Firm*—Jay H. Maioli

[57] ABSTRACT

An acoustic equalizer for use in a speaker unit including a central member in the shape of a generally spherical cone and a plurality of annular members arranged coaxially around the central member, the innermost one of which is partially linked through a linking portion to the central member with an annular vacant space between and each adjacent two of which are partially linked through another linking portion to each other with an annular vacant space between, wherein first ring-shaped end portions of the annular members and a first end portion of the central member surrounded with the first ring-shaped end portions of the annular members are provided to form in its entirety a spherical surface portion for facing a diaphragm member of a speaker unit and second ring-shaped end portions of the annular members opposite to the first ring-shaped end portions and a second end portion of the central member opposite to the first end portion and surrounded with the second ring-shaped end portions of the annular members are put an a virtual curved surface extending along the spherical surface portion. The acoustic equalizer contributes to causing a reproduced sound obtained from a speaker unit to be widely dispersed especially in a high frequency range.

9 Claims, 8 Drawing Sheets

SPEAKER UNIT WITH AN IMPROVED ACOUSTIC EQUALIZER

BACKGROUND OF THE INVENTION

1. Field of the Invention

The present invention relates generally to a speaker unit with an improved acoustic equalizer, and is directed to an improvement in an acoustic equalizer for use in a speaker unit, which comprises a central member in the shape of a generally spherical cone and a plurality of annular members arranged coaxially around the central member to be apart with a small distance from the central member and to have a small space between each adjacent two and the central and annular members of which are provided with end portions forming in its entirety a part of a generally spherical surface, and further directed to an improvement in a speaker unit in which such an acoustic equalizer as mentioned above is mounted on a center pole member to cause the end portions of the central and annular members to face an inner surface of a diaphragm member.

2. Description of the Prior Art

There has been proposed a speaker unit called a tweeter which has a voice coil, a diaphragm member driven by the voice coil to generate a reproduced sound and an acoustic equalizer with an end face portion thereof facing the diaphragm member with a gap between. The acoustic equalizer employed in the speaker unit used as the tweeter is formed into a specific shape with a plurality of annular vacant spaces arranged coaxially and positioned at the center of the speaker, as disclosed in, for example, the Japanese patent application published before examination with publication number HEI 7-231494.

Such an acoustic equalizer as disclosed in the Japanese patent application published before examination with publication number HEI 7-231494 comprises, for example, as shown in FIG. 1, a central member 1 in the shape of a generally spherical cone and a plurality of, for example, four annular members 2A, 2B, 2C and 2D each having a first ring-shaped end portion of larger diameter and a second ring-shaped end of smaller diameter. The annular members 2A to 2D are arranged coaxially around the central member 1 in such a manner that the annular member 2A surrounds the central member 1 to make an annular vacant space 4 between, the annular member 2B surrounds the annular member 2A to make an annular vacant space 4 between, the annular member 2C surrounds the annular member 2B to make an annular vacant space 4 between, and the annular member 2D surrounds the annular member 2C to make an annular vacant space 4. The annular member 2A is partially linked through a linking portion 5 with the central member 1, the annular member 2B is partially linked through a linking portion 6 with the annular member 2A, the annular member 2C is partially linked through a linking portion (not shown in FIG. 1) with the annular member 2B, and the annular member 2D is partially linked through a linking portion 6 with the annular member 2C.

The first ring-shaped end portion of each of the annular members 2A to 2D, which is of larger diameter, and a first end portion of the central member 1 surrounded with the first ring-shaped end portion of the annular member 2A are provided to form in its entirety a spherical surface portion 7. The spherical surface portion 7 is positioned to face an inner surface of a diaphragm member with a gap between this when the acoustic equalizer is mounted on a speaker. The diaphragm member is provided at its peripheral portion with a voice coil. The second ring-shaped end portion of each of the annular members 2A to 2D, which are of smaller diameter, and a second end portion of the central member 1 surrounded with the second ring-shaped end portion of the annular member 2A are put on a virtual plane 8.

The annular member 2D which is the outermost one of the annular members 2A to 2D is provided with a plurality of projections 9 at predetermined intervals on a virtual circle surrounding the annular member 2D. Each of the projections 9 is formed to project from an outer surface of a portion close to the first ring-shaped end portion of the annular member 2D so as to be fitted in an engaging hole 3A provided on a center pole member 3 of the speaker when the acoustic equalizer is mounted on the speaker. The projection 9 which is directly fitted into the engaging hole 3A provided on the center pole member 3 is fixed, for example, with adhesive agent in the engaging hole 3A, so that the acoustic equalizer which comprises the central member 1 and the annular members 2A to 2D is mounted in its entirety on the center pole member 3 to be supported thereby.

The speaker with the acoustic equalizer which comprises the central member and the annular members arranged coaxially around the central member, as described above, is generally produced to be used as a tweeter and therefore is required to generate a reproduced sound which is more widely dispersed in a high frequency range. Accordingly, the acoustic equalizer is also required to be fit for the purpose of obtaining the reproduced sound expansionary especially in the high frequency range.

However, it is unable to say that the previously proposed acoustic equalizer, such as explained above, contributes to causing the reproduced sound obtained from the speaker to be dispersed especially in the high frequency range. In addition, in the previously proposed acoustic equalizer, it is feared that a harsh noise is produced by undesirable vibrations raised at the second ring-shaped end portions of the annular members arranged coaxially around the central member.

Further because in the speaker which employs the acoustic equalizer comprising the central member and the annular members arranged coaxially around the central member is generally required to generate the reproduced sound more widely dispersed especially in the high frequency range, relatively high frequency variations in sound pressure are exerted on the acoustic equalizer raising vibrations. Therefore, in the case where the acoustic equalizer is firmly fixed to the center pole member of the speaker, a resonance of the whole structure including the acoustic equalizer and the center pole member is easily brought about and vibrations transmitted through the center pole member are easily exerted on the acoustic equalizer so that the reproduced sound is distorted.

Under such a condition, in the case of the previously proposed speaker in which each of the projections provided on the acoustic equalizer is directly fitted into the engaging hole provided on the center pole member to be fixed, for example, with adhesive agent in the engaging hole so that the acoustic equalizer is mounted in its entirety on the center pole member to be supported thereby, the acoustic equalizer is directly and firmly linked with the center pole member and therefore a resonance of the whole structure including the acoustic equalizer and the center pole member is easily caused by vibrations raised on the acoustic equalizer and transmitted to the center pole or vibrations transferred through the center pole member are easily exerted on the acoustic equalizer. Consequently, it is feared that the acoustic equalizer supported by the center pole with resonate undesirably with the center pole member due to vibrations raised on itself or vibrations thereon vibrations thereon resulting from the vibrations transmitted through the center pole member and therefore distortions in the reproduced sound are easily brought about.

OBJECTS AND SUMMARY OF THE INVENTION

Accordingly, it is an object of the present invention to provide an acoustic equalizer comprising a central member in the shape of a generally spherical cone and a plurality of annular members arranged coaxially around the central member, in which the innermost one of the annular members is partially linked to the central member with an annular vacant space between and each adjacent two of the annular members are partially linked to each other with an annular vacant space between, and which avoids the aforementioned problems and difficulties encountered with the prior art.

Another object of the present invention is to provide an acoustic equalizer comprising a central member in the shape of a generally spherical cone and a plurality of annular members arranged coaxially around the central member, in which the innermost one of the annular members is partially linked to the central member with an annular vacant space between and each adjacent two of the annular members are partially linked to each other with an annular vacant space between, and which contributes effectively to causing a reproduced sound obtained from a speaker to be widely dispersed especially in a high frequency range and is prevented from raising thereon undesirable vibrations when the whole acoustic equalizer is mounted on the speaker.

It is a further object of the present invention to provide a speaker unit in which an acoustic equalizer which comprises a central member in the shape of a generally spherical cone and a plurality of annular members arranged coaxially around the central member and in which the innermost one of the annular members is partially linked to the central member with an annular vacant space between and each adjacent two of the annular members are partially linked to each other with an annular vacant space between, is mounted on a center pole member to cause an end face portion of the acoustic equalizer to face an inner surface of a diaphragm member with a gap between and the diaphragm member is provided at its peripheral portion with a voice coil, and which avoids the aforementioned problems and difficulties encountered with the prior art.

A still further object of the present is to provide a speaker unit in which an acoustic equalizer which comprises a central member in the shape of a generally spherical cone and a plurality of annular members arranged coaxially around the central member and in which the innermost one of the annular members is partially linked to the central member with an annular vacant space between and each adjacent two of the annular members are partially linked to each other with an annular vacant space between, is mounted on a center pole member to cause an end face portion of the acoustic equalizer to face an inner surface of a diaphragm member with a gap between and the diaphragm member is provided at its peripheral portion with a voice coil, and which can prevent the acoustic equalizer from resonating undesirably with the center pole member and further from raising undesirable vibrations thereon resulting from vibrations transmitted through the center pole member.

According to the present invention, there is provided an acoustic equalizer for use in a speaker unit, which comprises a central member in the shape of a generally spherical cone and a plurality of annular members arranged coaxially around the central member, the innermost one of which is partially linked through a linking portion to the central member with an annular vacant space between and each adjacent two of which are partially linked through another linking portion to each other with an annular vacant space between, wherein first ring-shaped end portions of the annular members and a first end portion of the central member surrounded with the first ring-shaped end portions of the annular members are provided to form in its entirety a spherical surface portion for facing a diaphragm member of a speaker unit, and second ring-shaped end portions of the annular members, which are opposite to the first ring-shaped end portions, and a second end portion of the central member, which is opposite to the first end portion and surrounded with the second ring-shaped end portions of the annular members, are put on a virtual curved surface which extends along the spherical surface portion formed by the first ring-shaped end portions of the annular members and the first end portion of the central member.

In one embodiment of the acoustic equalizer according to the present invention, each adjacent two of the annular members are partially linked to each other through a couple of linking portions provided at positions on the side of the first ring-shaped end portion and on the side of the second ring-shaped end portion of each of the annular members, respectively.

As for the acoustic equalizer thus constituted in accordance with the present invention, it has been ascertained through experiments conducted by the inventor of the present invention that since the second ring-shaped end portions of the annular members and the second end portion of the central member surrounded with the second ring-shaped end portions of the annular members are put on the virtual curved surface which extends along the spherical surface portion formed by the first ring-shaped end portions of the annular members and the first end portion of the central member, the acoustic equalizer according to the present invention contributes effectively to causing a reproduced sound obtained from a speaker unit to be expansionary especially in a high frequency range when it is mounted on the speaker unit.

In addition, in the acoustic equalizer constituted as mentioned above in accordance with the present invention, the linking portions for linking each adjacent two of the annular members partially to each other are provided at the positions on the side of the first ring-shaped end portion and on the side of the second ring-shaped end portion of each of the annular members, respectively, and therefore the annular members are prevented from arising undesirable vibrations especially on the second ring-shaped end portions thereof.

Further according to the present invention, there is provided a speaker unit comprising a diaphragm member provided at a peripheral portion thereof with a voice coil, an acoustic equalizer which comprises a central member in the shape of a generally spherical cone and a plurality of annular members arranged coaxially around the central member, the innermost one of which is partially linked through a linking portion to the central member with an annular vacant space between, each adjacent two of which are partially linked through another linking portion to each other with an annular vacant space between, and the outermost one of which is provided with a plurality of projections for mounting, a center pole member having a concave portion for facing an outer surface of the outermost one of the annular members on which the projections are provided and a plurality of engaging holes provided on the concave portion to correspond to the projections provided on the outer surface of the outermost one of the annular members, respectively, wherein each of the projections provided on the outer surface of the outermost one of the annular members is fitted through an elastic member into the respective engaging hole provided on the concave portion of the center pole member to be fixed therein and thereby the acoustic equalizer is mounted on the center pole member with the outer surface of the outermost one of the annular members facing closely the concave portion of the center pole member so that ring-shaped end portions of the annular members and an end portion of the central member surrounded with the ring-shaped end portions of the annular members are positioned to face an inner surface of the diaphragm member with a gap between.

In the speaker unit thus constituted in accordance with the present invention, since each of the projections provided on the outer surface of the outermost one of the annular members forming the acoustic equalizer is fitted through the elastic member into the respective engaging hole provided on the concave portion of the center pole member to be fixed therein, each of the engaging holes is not in contact directly with the projection provided on the outermost one of the annular members but in contact through the elastic member with the projection provided on the outermost one of the annular members and therefore the elastic member is operative to interrupt transmission of vibrations between the center pole member and the acoustic equalizer.

Consequently, even if relatively high frequency variations in sound pressure are exerted on the acoustic equalizer so as to cause the acoustic equalizer to raise a few vibrations, the center pole member and the acoustic equalizer are effectively prevented from resonating with each other and the acoustic equalizer is further prevented from raising thereon undesirable vibrations resulting from vibrations transmitted through the center pole member, so that distortions in a reproduced sound obtained from the speaker unit is effectively suppressed.

The above, and other objects, features and advantages of the present invention will become apparent from the following detailed description taken in conjunction with the accompanying drawings.

DESCRIPTION OF THE PREFERRED EMBODIMENTS

Figure 1:
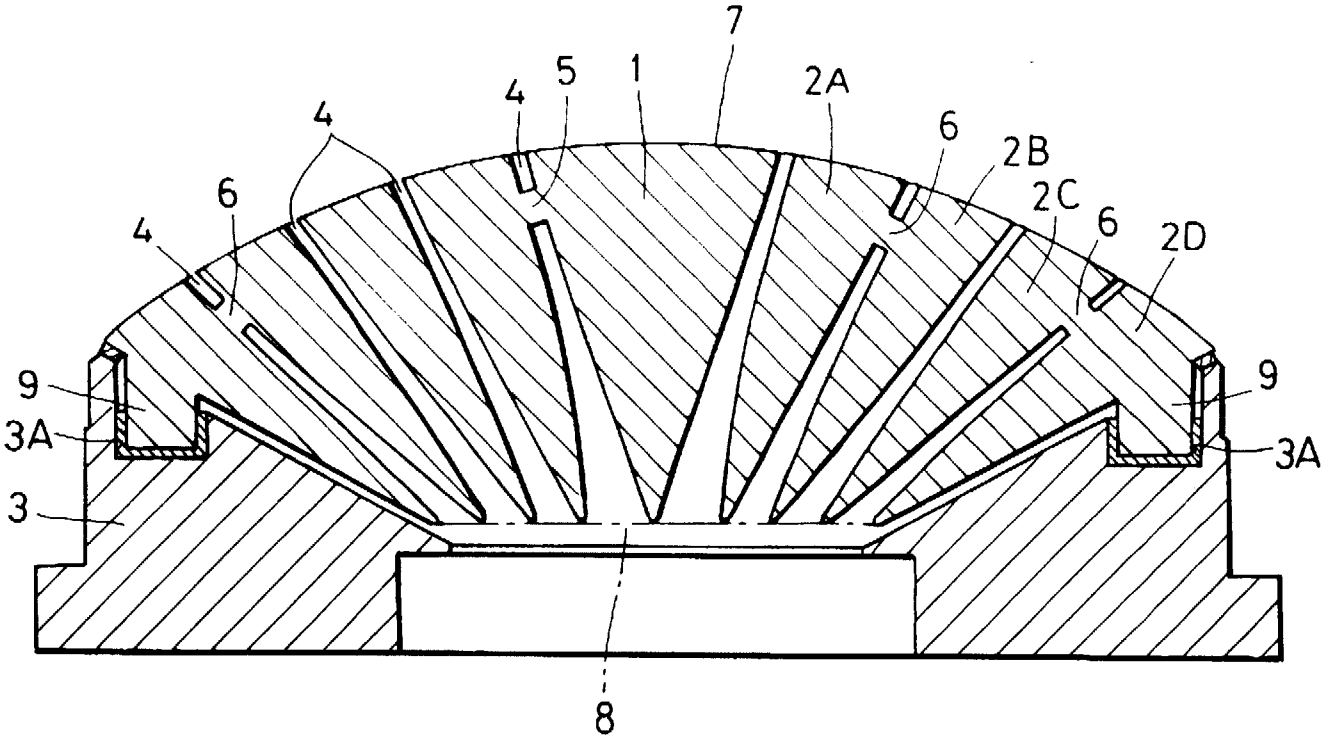
FIG. 1 PRIOR ART
FIG. 1 is a cross-sectional view showing an acoustic equalizer and a center pole member of a previously proposed speaker unit.
Figure 2:
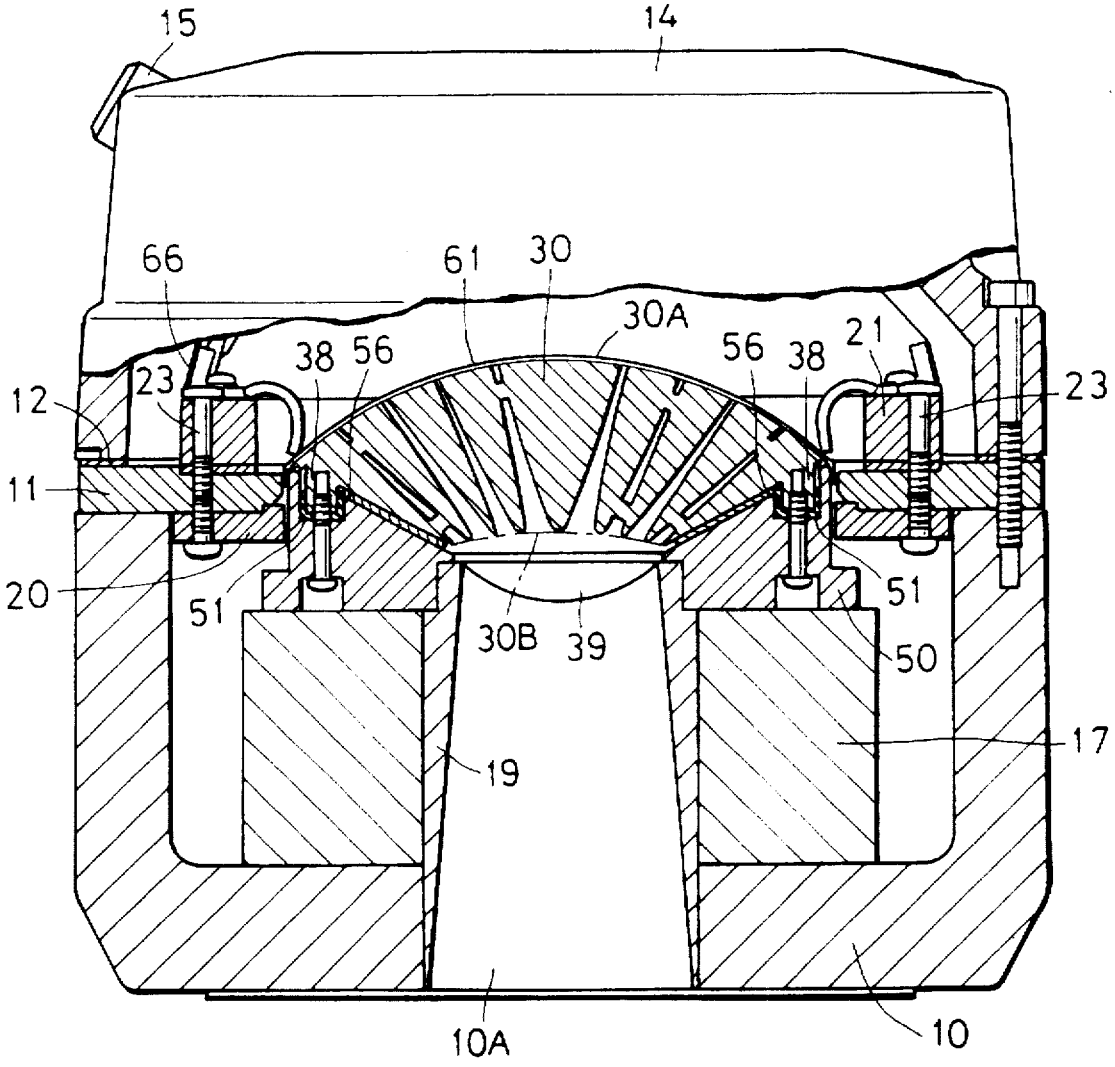
FIG. 2 is a cross-sectional view showing an embodiment of speaker unit according to the present invention in which an embodiment of acoustic equalizer according to the present invention is employed.

FIG. 2 shows an embodiment of speaker unit according to the present invention in which an embodiment of the acoustic equalizer according to the present invention is employed.

Referring to FIG. 2, an embodiment of a speaker unit according to the present invention is provided with a cup-shaped magnetic yoke 10 having a bottom provided thereon with a center opening 10A, a cover member 14 screwed through a ring plate 11 and an annular seal member 12 on the magnetic yoke 10, and a connecting terminal 15 passing through the cover member 14. A sound absorbing material (not shown in FIG. 2) is attached to an inner surface of the cover member 14.

In a space formed by the magnetic yoke 10 and the cover member 14, a ring magnet 17 fixed on the bottom of the magnetic yoke 10 to form therein a hollow space following the center opening 10A, an acoustic equalizer 30 made of metal or plastics, and a center pole member 50 fixed on the ring magnet 17 to be placed between the ring magnet 17 and the acoustic equalizer 30 and to form therein a hollow space extending from the hollow space formed in the ring magnet 17 are contained. The center pole member 50 is made of iron and plated with copper. The acoustic equalizer 30 is mounted on the center pole member 50. The magnetic yoke 10, ring plate 11, ring magnet 17 and center pole member 50 form in its entirety a magnetic circuit.

A tubular throat member 19 is inserted into the center opening 10A provided on the bottom of the magnetic yoke 10, the hollow space formed in the ring magnet 17 and the hollow space formed in the center pole member 50 to form therein a sound passage from the acoustic equalizer 30 to the outside of the speaker unit.

A ring plate 20 surrounding the center pole member 50 is in contact with a surface of the ring plate 11 on the side of the magnetic yoke 10 and an annular frame member 21 surrounding the acoustic equalizer 30 is in contact with a surface of the ring plate 11 on the side of the cover member 14.

Figure 3:
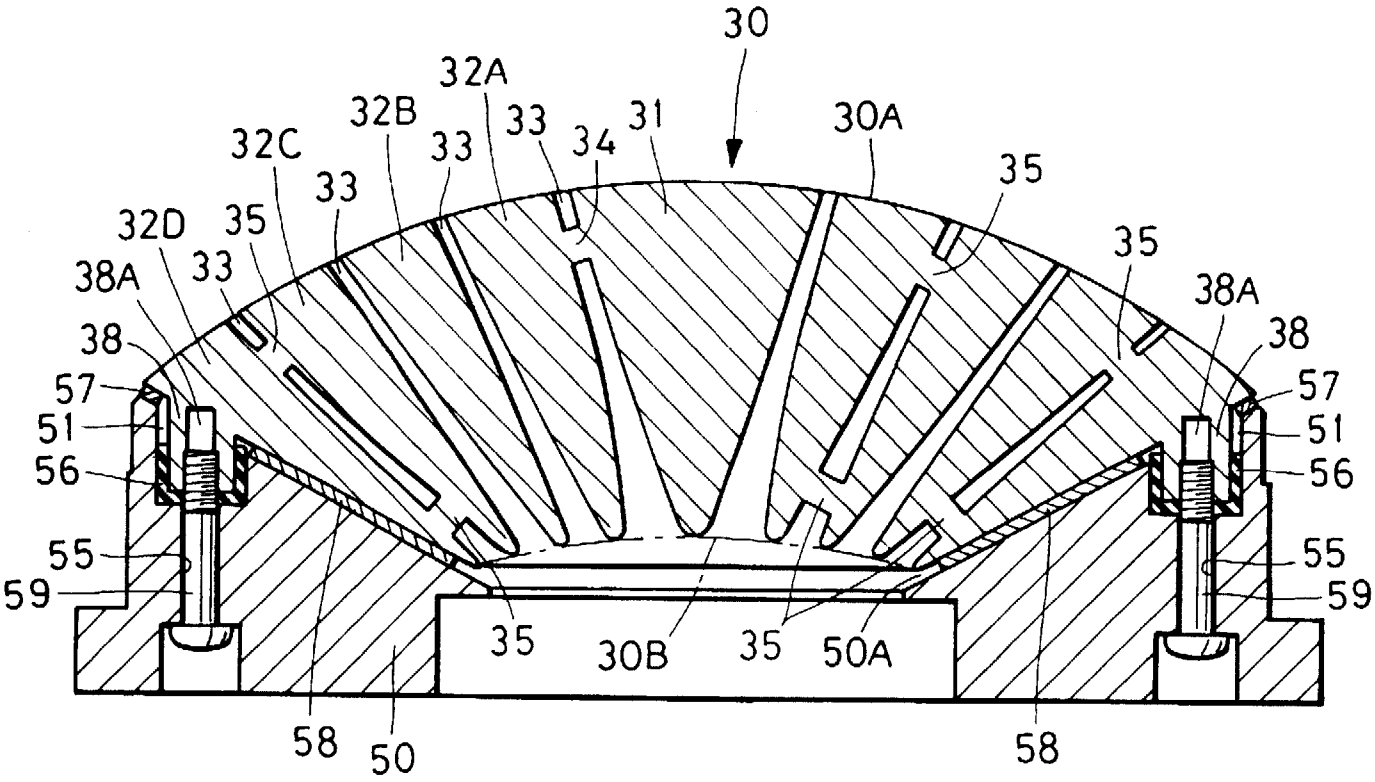
FIG. 3 is a cross-sectional view showing an essential part of the embodiment of speaker unit according to the present invention.
Figure 4:
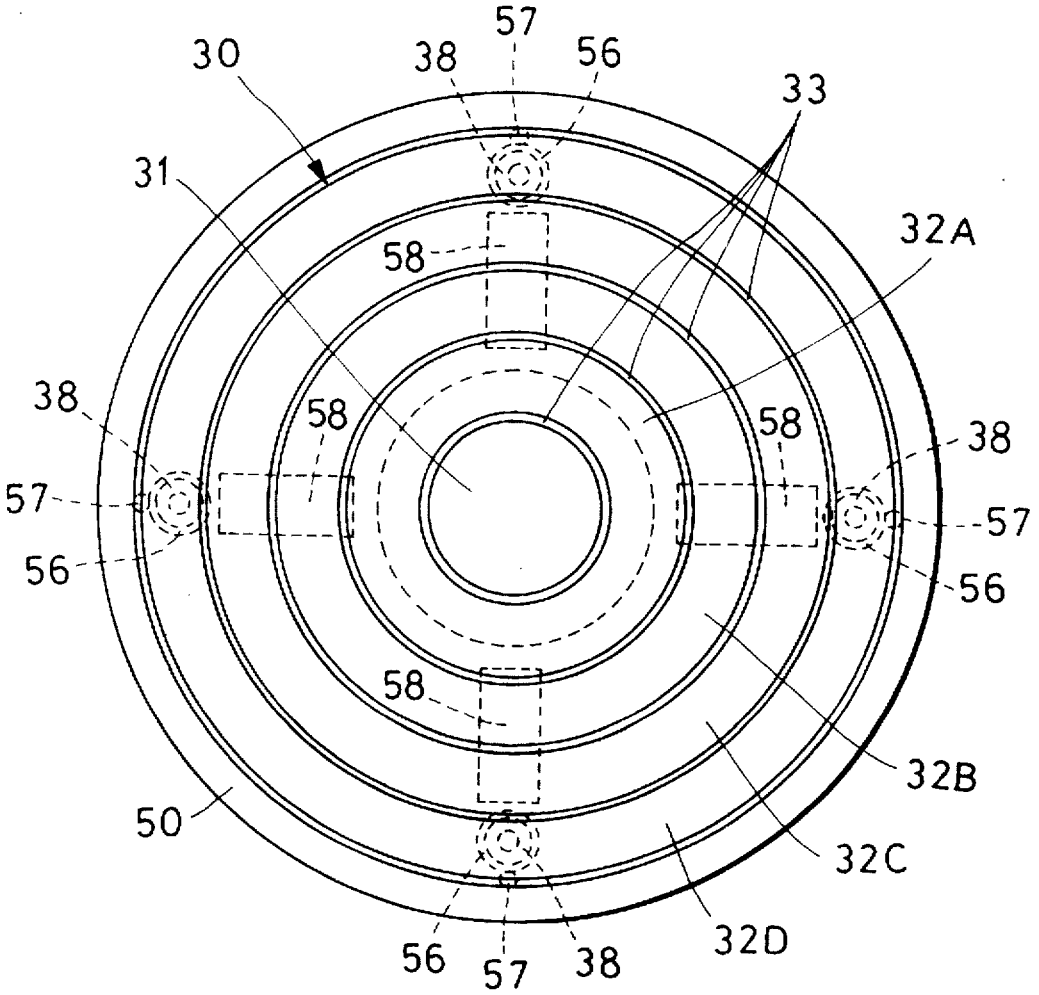
FIG. 4 is a plane view showing an essential part of the embodiment of speaker unit according to the present invention.

The acoustic equalizer 30 comprises, as shown in FIG. 3 and FIG. 4, a central member 31 in the shape of a generally spherical cone and a plurality of, for example, four annular members 32A, 32B, 32C and 32D each having a first ring-shaped end portion of larger diameter and a second ring-shaped end of smaller diameter. The annular members 32A to 32D are arranged coaxially around the central member 31 in such a manner that the annular member 32A surrounds the central member 31 to make an annular vacant space 33 between, the annular member 32B surrounds the annular member 32A to make an annular vacant space 33 between, the annular member 32C surrounds the annular member 32B to make an annular vacant space 33 between, and the annular member 32D surrounds the annular member 32C to make an annular vacant space 33.

The annular member 32A is partially linked through a linking portion 34 with the central member 31, the annular members 32B is partially linked through linking portions 35 with the annular member 32A, the annular member 32C is partially linked through linking portions 35 (not shown in FIG. 3) with the annular member 32B, and the annular member 32D is partially linked through linking portions 35 with the annular member 32C. The linking portion 34 linking the annular member 32A with the central member 31 is incorporated with the central member 31 and the annular member 32A and provided at a position on the side of the first ring-shaped end portion of the annular member 32A. The linking portions 35 linking the annular members 32A and 32B with each other are incorporated with the annular members 32A and 32B and provided at positions on the side of the first ring-shaped end portion and on the side of the second ring-shaped end portion of each of the annular members 32A and 32B, respectively.

Similarly, the linking portions 35 (not shown in FIG. 3) linking the annular members 32B and 32C with each other are incorporated with the annular members 32B and 32C and provided at positions on the side of the first ring-shaped end portion and on the side of the second ring-shaped end portion of each of the annular members 32B and 32C, respectively. Further, the linking portions 35 linking the annular members 32C and 32D with each other are incorporated with the annular members 32C and 32D and provided at positions on the side of the first ring-shaped end portion and on the side of the second ring-shaped end portion of each of the annular members 32C and 32D, respectively. Namely, the central member 31 and the annular members 32A to 32D constituting the acoustic equalizer 30 are incorporated with the linking portions 34 and 35.

Figure 5:
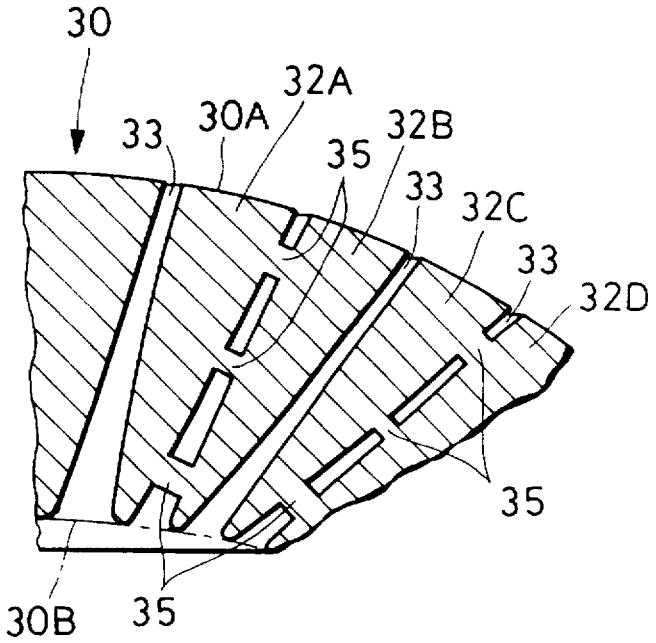
FIG. 5 is a partial cross-sectional view used for explaining the embodiment of acoustic equalizer according to the present invention.

Incidentally, as shown in FIG. 5, it is also possible that the linking portions 35 linking the annular members 32A and 32B with each other are provided at positions on the side of the first ring-shaped end portion, in the middle, and on the side of the second ring-shaped end portion of each of the annular members 32A and 32B, respectively, the linking portions 35 (not shown in FIG. 5) linking the annular members 32B and 32C with each other are provided at positions on the side of the first ring-shaped end portion, in the middle, and on the side of the second ring-shaped end portion of each of the annular members 32B and 32C, respectively, and the linking portions 35 linking the annular members 32C and 32D with each other are provided at positions on the side of the first ring-shaped end portion, in the middle, and on the side of the second ring-shaped end portion of each of the annular members 32C and 32D, respectively.

Figure 6:
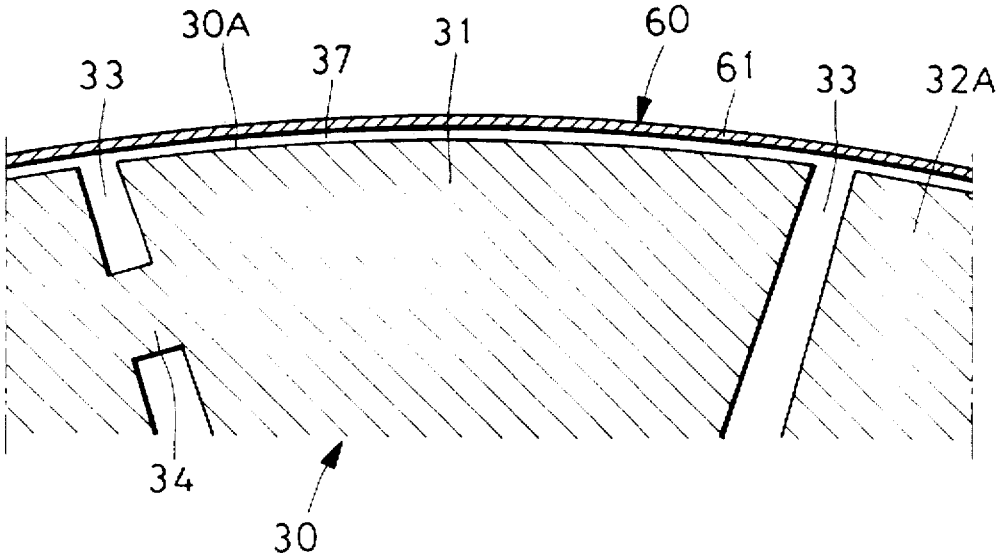
FIG. 6 is a partial cross-sectional view used for explaining the embodiment of acoustic equalizer according to the present invention and a diaphragm member of the embodiment of speaker unit according to the present invention.

The first ring-shaped end portion of each of the annular members 32A to 32D, which is of larger diameter, and a first end portion of the central member 31 surrounded with the first ring-shaped end portion of the annular member 32A are arranged to form in its entirety a spherical surface portion 30A. As shown in FIG. 6, the spherical surface portion 30A is positioned to face an inner surface of a dome portion 61 constituting a diaphragm member 60 with a gap 37 between, when the acoustic equalizer 30 is mounted on the center pole member 50. In other words, the first ring-shaped end portion of each of the annular members 32A to 32D and the first end portion of the central member 31 surrounded with the first ring-shaped end portion of the annular member 32A are positioned to face the diaphragm member 60 with the gap 37 between, when the acoustic equalizer 30 is mounted on the center pole member 50.

The second ring-shaped end portion of each of the annular members 32A to 32D, which is of smaller diameter, and a second end portion of the central member 31 surrounded with the second ring-shaped end portion of the annular member 32A are put on a virtual curved surface 30B. The virtual curved surface 30B extends along the spherical surface portion 30A formed by the first ring-shaped end portions of the annular members 32A to 32D and the first end portion of the central member 31, so that the virtual curved surface 30B forms a concavity corresponding to a convexity formed by the spherical surface portion 30A.

The virtual curved surface 30B which extends thus along the spherical surface portion 30A and on which the second ring-shaped end portions of the annular members 32A to 32D and the second end portion of the central member 31 are put is disposed all over to be apart by a constant distance from the spherical surface portion 30A and therefore the annular vacant spaces 33 which are formed between the central member 31 and the annular member 32A, between the annular members 32A and 32B, between the annular members 32B and 32C and between the annular members 32C and 32D, respectively, to provide sound passages in the acoustic equalizer 30, have substantially the same length in the direction from the spherical surface portion 30A to the virtual curved surface 30B.

Each of the annular vacant spaces 33 has a first annular opening of narrower width on the spherical surface portion 30A formed by the first ring-shaped end portions of the annular members 32A to 32D and the first end portion of the central member 31 and a second annular opening of wider width on the virtual curved surface 30B on which the second ring-shaped end portions of the annular members 32A to 32D and the second end portion of the central member 31 are put.

The annular member 32D which is the outermost one of the annular members 32A to 32D is provided with a plurality of, for example, four projections 38 at predetermined intervals on a virtual circle surrounding the annular member 32D. For example, the projections 38 are positioned at angular intervals of 90 degrees with a center on an imaginary central axis of the central member 31. Each of the projections 38 is formed to project from an outer surface of a portion close to the first ring-shaped end portion of the annular member 32D toward the second ring-shaped end portion of the annular member 32D along the imaginary central axis of the central member 31, and is provided with a tapped hole 38A.

The acoustic equalizer 30 thus constituted is mounted on the center pole member 50 in such a manner that the spherical surface portion 30A which is formed by the first ring-shaped end portions of the annular members 32A to 32D and the first end portion of the central member 31 is covered by the dome portion 61 constituting the diaphragm member 60 and the second ring-shaped end portions of the annular members 32A to 32D and the second end portion of the central member 31 which are put on the virtual curved surface 30B are covered by a dust screen 39 in the shape of a dome, as shown in FIG. 2. Thereby, the acoustic equalizer 30 is supported in its entirety by the center pole member 50.

The center pole member 50 is provided with a concave portion 50A for facing the outer surface of the annular member 32D constituting the acoustic equalizer 30 and four engaging holes 51 are provided on the concave portion 50A at positions close to a peripheral portion of the concave portion 50A to correspond to four projections 38 provided to project from the outer surface of the annular member 32D, respectively. In the center pole member 50, a hole 55 is provided to extend from the bottom of each of the engaging holes 51 toward the ring magnet 17.

Figure 7:
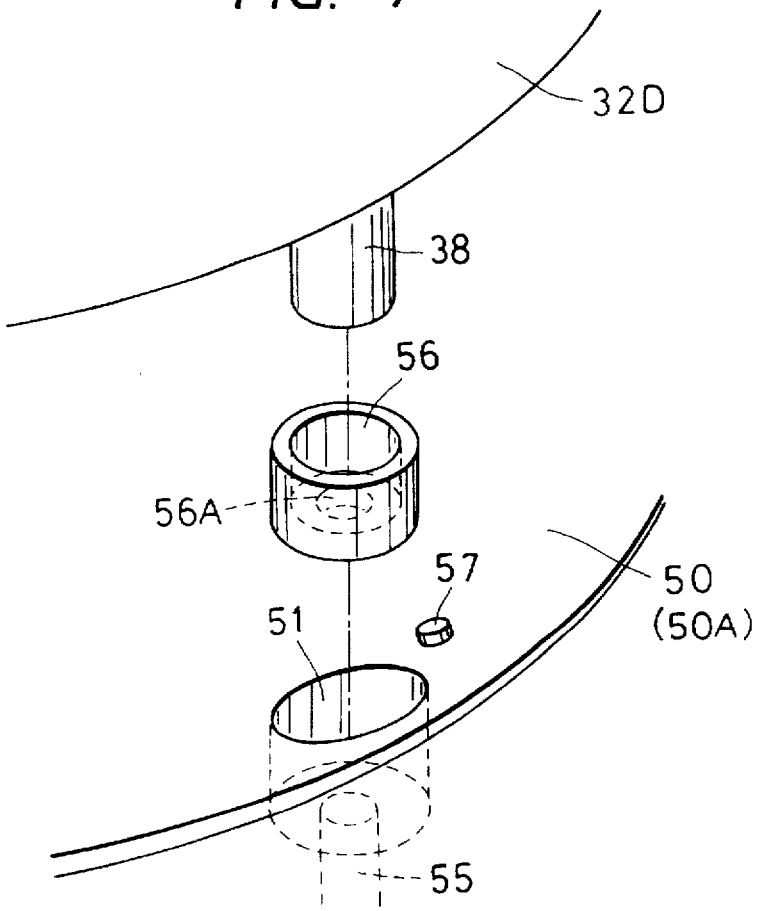
FIG. 7 is a fragmentary perspective view used for explaining a projection provided on the embodiment of acoustic equalizer according to the present invention and an engaging hole provided on a center pole member of the embodiment of speaker unit according to the present invention.

When the acoustic equalizer 30 is in process of mounting on the center pole member 50, the acoustic equalizer 30 is put on the center pole member 50 in such a manner that each of the projections 38 provided on the annular member 32D constituting the acoustic equalizer 30 is fitted into the respective engaging hole 51 provided on the concave portion 50A of the center pole member 50. On that occasion, an elastic member 56 made of, for example, rubber material is put in each of the engaging holes 51 and therefore each of the projections 38 is fitted through the elastic member 56 into the engaging hole 51. As shown in FIG. 7, the elastic member 56 is cup-shaped in accordance with the shape of the projection 38 and provided with an opening 56A coupled to the hole 55 at a portion thereof in contact with the bottom of the engaging hole 51.

When the acoustic equalizer 30 is in process of mounting on the center pole member 50, a disc spacer 57 made of, for example, brass is also disposed on the concave portion 50A of the center pole member 50 in the vicinity of each of the engaging holes 51 so as to be put between the outer surface of the annular member 32D constituting the acoustic equalizer 30 and the concave portion 50A of the center pole member 50. Further, a plurality of, for example, four double-faced adhesive tapes 58 are put between the outer surface of the annular member 32D constituting the acoustic equalizer 30 and the concave portion 50A of the center pole member 50. Each of these double-faced adhesive tapes 58 functions as an elastic member operative to suppress undesirable vibrations raised on the acoustic equalizer 30 and the center pole member 50 which are in a resonant condition.

After each of the projections 38 provided on the annular member 32D constituting the acoustic equalizer 30 has been fitted through the elastic member 56 into the engaging hole 51 provided on the concave portion 50A of the center pole member 50, a bolt 59 is screwed through the hole 55 provided in the center pole member 50 and the opening 56A provided on the elastic member 56 in the tapped hole 38A provided in the projection 38 so as to fix the projection 38 in the engaging hole 51. Thereby, the acoustic equalizer 30 is mounted on the center pole member 50 in such a manner that the concave portion 50A of the center pole member 50 faces closely the annular member 32D constituting the acoustic equalizer 30.

Since each of the projections 38 provided on the annular member 32D is fitted through the elastic member 56 into the engaging hole 51 provided on the concave portion 50A of the center pole member 50 to be fixed therein, the center pole member 50 is not in contact directly with the projections 38 but in contact through the elastic member 56 with the projections 38.

Figure 9:
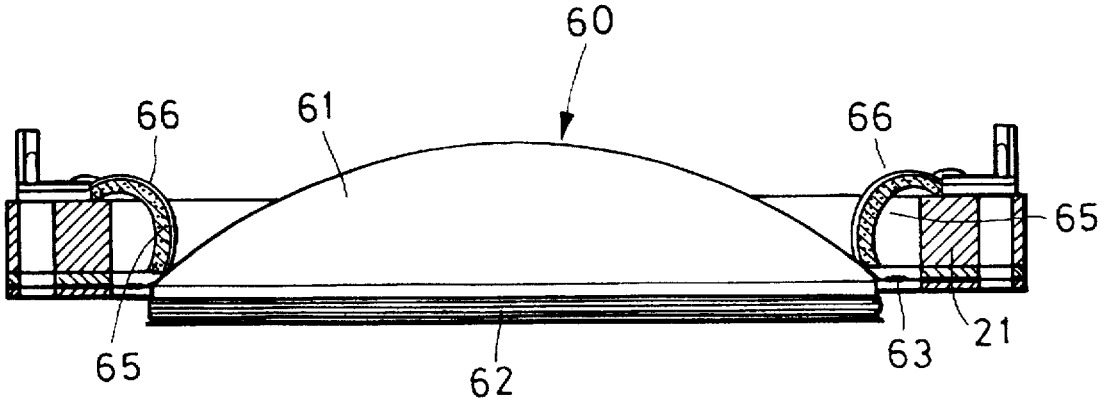
FIG. 9 is a side view used for explaining the diaphragm member of the embodiment of speaker unit according to the present invention.
Figure 8:
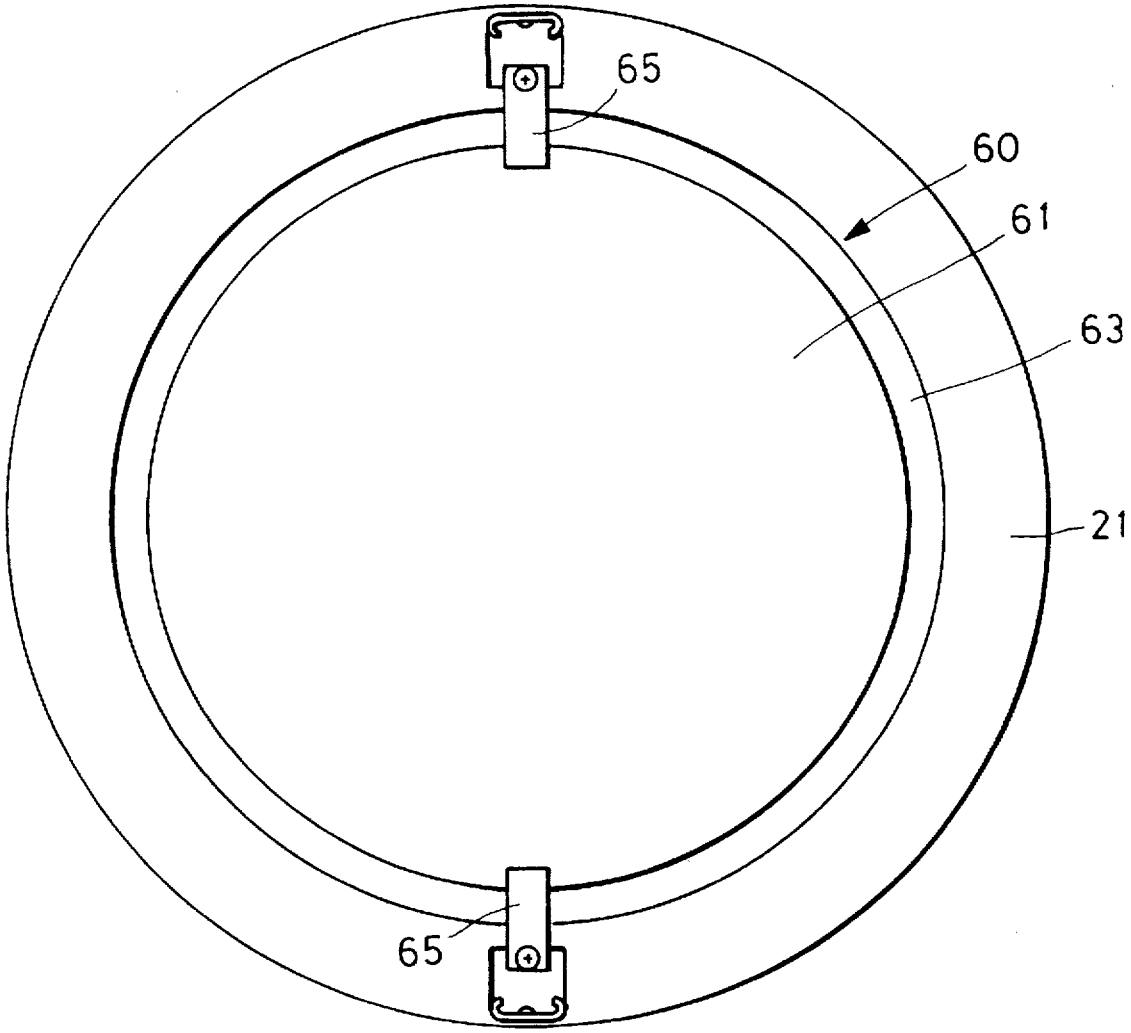
FIG. 8 is a plane view used for explaining the diaphragm member of the embodiment of speaker unit according to the present invention.

As shown in FIG. 8 and FIG. 9, the diaphragm member 60 constituted by the dome portion 61 to cover the acoustic equalizer 30 with the gap 37 between is provided on a periphery of the dome portion 61 with a voice coil 62, and the dome portion 61 and an edge portion 63 surrounding the dome portion 61 are supported by the annular frame member 21 surrounding the edge portion 63. The annular frame member 21 is screwed to the surface on the side of the cover member 14 of the ring plate 11 with the bolt 23, so that the voice coil 62 is put in a magnetic field produced by the magnetic circuit comprising the magnetic yoke 10, the ring plate 11, the ring magnet 17 and the center pole member 50 to face the ring plate 11.

A pair of damping members 65 opposite to each other are attached to the annular frame member 21 to extend toward the diaphragm member 60. Each of the damping members 65 is made of rubber material or soft plastics to be elastic. A connecting lead 66 extending from the connecting terminal 15 to pass through the cover member 14 is connected with each of the damping members 65 to be led to the voice coil 62.

In the embodiment of speaker unit according to the present invention which is constituted as shown in FIG. 2 and described above, each of the engaging holes 51 provided on the concave portion 50A of the center pole member 50, by which the acoustic equalizer 30 is supported, is not in contact directly with the projection 38 provided on the annular member 32D constituting the acoustic equalizer 30 but in contact through the elastic member 56 with the projection 38, and therefore the elastic member 56 is operative substantially to interrupt transmission of vibrations between the center pole member 50 and the acoustic equalizer 30. Consequently, even if relatively high frequency variations in sound pressure are exerted on the acoustic equalizer 30 so as to cause the acoustic equalizer 30 to raise a few vibrations, the center pole member 50 and the acoustic equalizer 30 are effectively prevented from resonating with each other and the acoustic equalizer 30 is further prevented from raising thereon undesirable vibrations resulting from vibrations transmitted through the center pole member 50, so that distortions in a reproduced sound obtained from the speaker unit are effectively suppressed.

Besides, as for the acoustic equalizer 30 which is the embodiment of acoustic equalizer according to the present invention, since the second ring-shaped end portions of the annular members 32A to 32D and the second end portion of the central member 31 surrounded with the second ring-shaped end portions of the annular members 32A to 32D are put on the virtual curved surface 30B which extends along the spherical surface portion 30A formed by the first ring-shaped end portions of the annular members 32A to 32D and the first end portion of the central member 31 and therefore the annular vacant spaces 33 which provide sound passages in the acoustic equalizer 30 have substantially the same length in the direction from the spherical surface portion 30A to the virtual curved surface 30B, the acoustic equalizer 30 contributes effectively to causing a reproduced sound obtained from the speaker unit to be expansionary especially in a high frequency range.

In addition, in the acoustic equalizer 30, the linking portions 35 for linking each adjacent two of the annular members 32A to 32D partially to each other are provided at the positions on the side of the first ring-shaped end portion and on the side of the second ring-shaped end portion of each of the annular members 32A to 32D, respectively, and therefore the annular members 32A to 32D are prevented from arising undesirable vibrations especially on the second ring-shaped end portions thereof.

Figure 10:
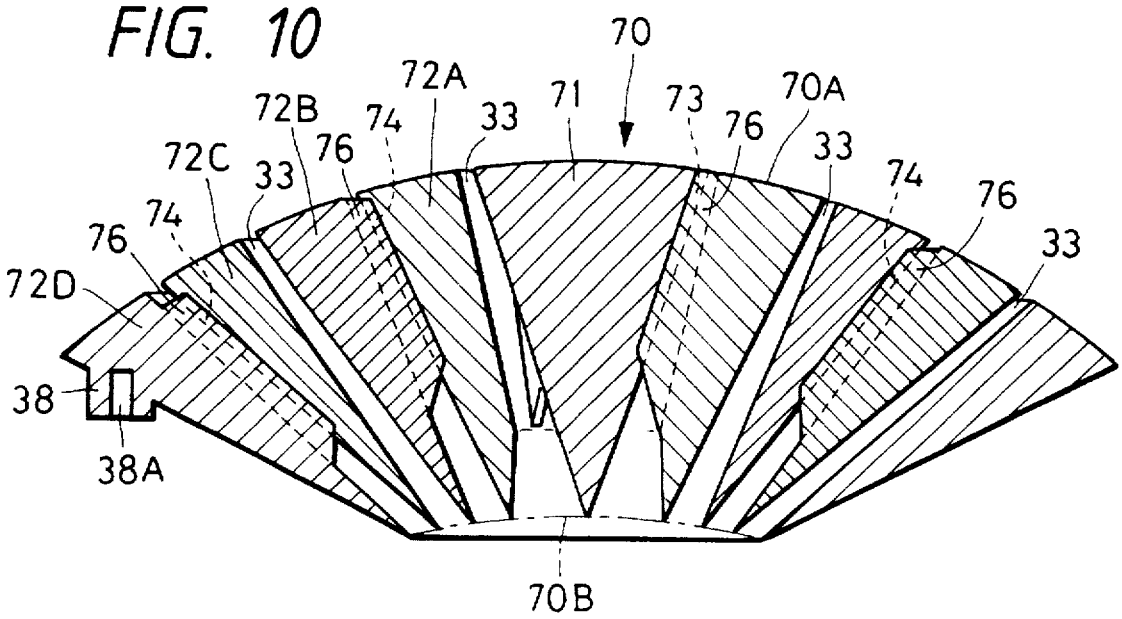
FIG. 10 is a cross-sectional view showing another embodiment of acoustic equalizer according to the present invention.
Figure 11:
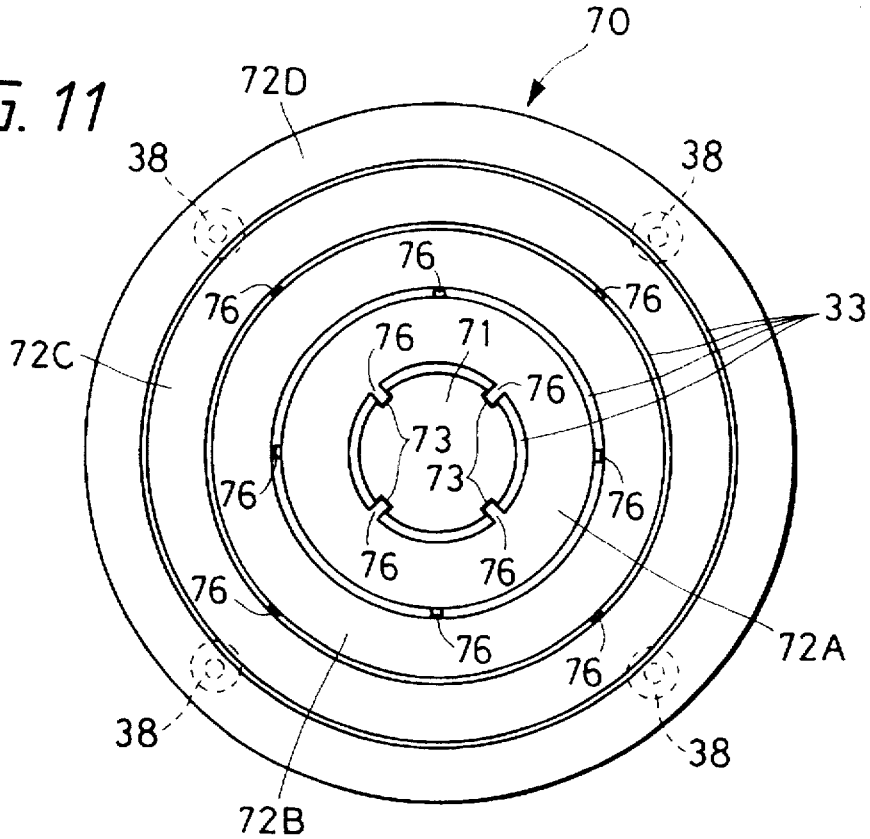
FIG. 11 is a plane view showing the embodiment of acoustic equalizer shown in FIG. 10.

FIG. 10 and FIG. 11 show another embodiment of acoustic equalizer according to the present invention, which is able to be employed also in the embodiment of speaker unit shown in FIG. 2.

Although the central member 31 is incorporated with the annular members 32A to 32D arranged coaxially around the central member 31, together with the linking portion 34 for linking the central member 31 to the annular member 32A and the linking portions 35 for linking each adjacent two of the annular members 32A to 32D to each other, in the acoustic equalizer 30 shown in FIG. 3 and FIG. 4, an acoustic equalizer 70 shown in FIG. 10 and FIG. 11 comprises a central member 71 and four annular members 72A, 72B, 72C and 72D arranged coaxially around the central member 71, wherein the central member 71 is able to be separated from the annular members 72A to 72D and the annular members 72A to 72D are able to be separated from each other.

Referring to FIG. 10 and FIG. 11, the central member 71 and the annular members 72A to 72D are different only in the linking manner from the central member 31 and the annular members 32A to 32D shown in FIG. 3 and FIG. 4 and arranged to constitute the acoustic equalizer 70 which is substantially the same as the acoustic equalizer 30. Various members and portions of the acoustic equalizer 70 shown in FIG. 10 and FIG. 11 corresponding to those of the acoustic equalizer 30 shown in FIG. 3 and FIG. 4 are marked with the same references and further description thereof will be omitted.

The central member 71 is shaped into a generally spherical cone and each of the annular members 72A to 72D has a first ring-shaped end portion of larger diameter and a second ring-shaped end of smaller diameter. The first ring-shaped end portion of each of the annular members 72A to 72D, which is of larger diameter, and a first end portion of the central member 71 surrounded with the first ring-shaped end portion of the annular member 72A are arranged to form in its entirety a spherical surface portion 70A. The second ring-shaped end portion of each of the annular members 72A to 72D, which is of smaller diameter, and a second end portion of the central member 71 surrounded with the second ring-shaped end portion of the annular member 72A are put on a virtual curved surface 70B. The virtual curved surface 70B extends along the spherical surface portion 70A formed by the first ring-shaped end portions of the annular members 72A to 72D and the first end portion of the central member 71.

The virtual curved surface 70B which extends thus along the spherical surface portion 70A and on which the second ring-shaped end portions of the annular members 72A to 72D and the second end portion of the central member 71 are put is disposed all over to be apart by a constant distance from the spherical surface portion 70A and therefore annular vacant spaces 33 which are formed between the central member 71 and the annular member 72A, between the annular members 72A and 72B, between the annular members 72B and 72C and between the annular members 72C and 72D, respectively, to provide sound passages in the acoustic equalizer 70, have substantially the same length in the direction from the spherical surface portion 70A to the virtual curved surface 70B.

A plurality of, for example, four engaging grooves 73 are provided on the outer surface of the central member 71 to extend from the first end portion toward the second end portion of the central member 71. Further, a plurality of, for example, four engaging grooves 74 are provided also on the outer surface of each of the annular members 72A to 72D to extend from the first ring-shaped end portion toward the second ring-shaped end portion of each of the annular members 72A to 72D.

The annular member 72A is partially linked to the central member 71 with an annular vacant space 33 between through four fin-shaped linking portions 76 each of which projects from an inner surface of the annular member 72A to engage with one of the engaging grooves 73 provided on the outer surface of the central member 71 and to be fixed in the engaging groove 73 with adhesive agent. The annular member 72B is partially linked to the annular member 72A with an annular vacant space 33 between through four fin-shaped linking portions 76 each of which projects from an inner surface of the annular member 72B to engage with one of the engaging grooves 74 provided on the outer surface of the annular member 72A and to be fixed in the engaging groove 74 with adhesive agent. The annular member 72C is partially linked to the annular member 72B with an annular vacant space 33 between through four fin-shaped linking portions 76 each of which projects from an inner surface of the annular member 72C to engage with one of the engaging grooves 74 provided on the outer surface of the annular member 72B and to be fixed in the engaging groove 74 with adhesive agent. The annular member 72D is partially linked to the annular member 72C with an annular vacant space 33 between through four fin-shaped linking portions 76 each of which projects from an inner surface of the annular member 72D to engage with one of the engaging grooves 74 provided on the outer surface of the annular member 72C and to be fixed in the engaging groove 74 with adhesive agent. With such linkages between the central member 71 and the annular member 72A and between each adjacent two of the annular members 72A to 72D, the central member 71 and the annular members 72A to 72D are substantially incorporated with each other.

What is claimed is:

1. An acoustic equalizer for use in a speaker unit comprising:

a central member shaped as a cone with a spherical base; and a plurality of annular members arranged coaxially around said central member, an innermost one of said plurality of members being partially linked through a linking portion to said central member forming a first annular vacant space in between, and each adjacent two of said annular members being partially linked through respective other linking portions to each other and forming other annular vacant spaces in between, wherein first ring-shaped end portions of said plurality of annular members and a first end portion of said central member form a first spherical surface portion for facing a diaphragm member of the speaker unit and second ring-shaped end portions of said plurality of annular members opposite to the first ring-shaped end portions and a second end portion of said central member opposite said spherical base form a second spherical surface portion spaced equidistantly along its surface from said first spherical surface portion, so that second spherical surface portion has a radius of curvature equal to a radius of curvature of said first spherical surface portion, and wherein the outermost one of said plurality of annular members is provided with a plurality of projections for engaging through a respective plurality of rubber elastic members with a supporting member.

2. The acoustic equalizer according to claim 1, wherein said first spherical surface portion is shaped into a convexity and said second spherical surface portion is shaped into a concavity corresponding in curvature to said convexity.

3. The acoustic equalizer according to claim 1, wherein each of said annular vacant spaces is formed to have a first annular opening of narrower width on said first spherical surface portion than a second annular opening on said second spherical surface and all of said annular vacant spaces are of equal length.

4. The acoustic equalizer according to claim 1, wherein each adjacent two of said annular members are partially linked to each other through a couple of linking portions provided at positions on the side of said first ring-shaped end portion and on the side of said second ring-shaped end portion of each of said annular members, respectively.

5. A speaker unit comprising:

a diaphragm member provided with a voice coil;

an acoustic equalizer including a conical central member with a spherical end, and a plurality of annular members arranged coaxially around said central member, an innermost one of said plurality of annular members being partially linked through a linking portion to said central member and forming a first annular vacant space in between, and each adjacent two of said plurality of annular members being partially linked to each other through other respective linking portions and forming other respective vacant spaces in between, and wherein an outermost one of said plurality of annular members is provided with a plurality of projections for mounting;

a center pole member including a concave portion for facing an outer surface of the outermost one of said plurality of annular members and a plurality of engaging holes provided on said concave portion corresponding respectively to said plurality of projections for mounting; and a plurality of rubber elastic members;

wherein said plurality of projections for mounting are fitted respectively through said plurality of rubber elastic members into said respective plurality of engaging holes provided on said concave portion of said center pole member to be fixed therein, and whereby said acoustic equalizer is mounted on said center pole member with the outer surface of the outermost one of said plurality of annular members facing the concave portion of said center pole member so that ring-shaped end portions of said plurality of annular members and an end portion of said central member surrounded with said ring-shaped end portions of said plurality of annular members are positioned to face said diaphragm member with a uniform gap therebetween.

6. The speaker unit according to claim 5, wherein each of said plurality of rubber elastic members is cup-shaped and is installed in said plurality of engaging holes provided on said concave portion of said center pole member.

7. The speaker unit according to claim 5, wherein said plurality of projections for mounting provided on said acoustic equalizer are fixed in said plurality of engaging holes provided on said center pole member with a respective plurality of bolts connecting said projections through the engaging holes and the respective plurality of rubber elastic members.

8. The speaker unit according to claim 5, wherein each of said plurality of projections for mounting is formed to project from said outmost one of said plurality of annular members away from said ring-shaped end portions of said plurality of annular members, and wherein the spherical end of said conical central member is positioned to face said diaphragm member with said gap therebetween.

9. The speaker unit according to claim 5, wherein a plurality of double-faced adhesive tapes are put in between said acoustic equalizer and said center pole member.

* * * * *